166-308
8/18/87 OR 4,687,061 SR

United States Patent [19]

Uhri

[11] Patent Number: 4,687,061

[45] Date of Patent: Aug. 18, 1987

[54] STIMULATION OF EARTH FORMATIONS SURROUNDING A DEVIATED WELLBORE BY SEQUENTIAL HYDRAULIC FRACTURING

[75] Inventor: Duane C. Uhri, Grand Prairie, Tex.

[73] Assignee: Mobil Oil Corporation, New York, N.Y.

[21] Appl. No.: 938,891

[22] Filed: Dec. 8, 1986

[51] Int. Cl.[4] ..... E21B 43/26

[52] U.S. Cl. ..... 166/308; 166/50; 166/297

[58] Field of Search ..... 166/308, 271, 256, 280, 166/297, 50

[56] References Cited

U.S. PATENT DOCUMENTS

| | | | |
|---|---|---|---|
| 3,313,348 | 4/1967 | Huitt et al. | 166/308 X |
| 3,682,246 | 8/1972 | Closmann | 166/271 |
| 3,810,510 | 5/1974 | Fitch et al. | 166/271 |
| 3,835,928 | 9/1974 | Strubhar et al. | 166/308 |
| 3,878,884 | 4/1975 | Raleigh | 166/308 X |
| 4,005,750 | 2/1977 | Shuck | 166/308 |
| 4,476,932 | 10/1984 | Emery | 166/50 |

*Primary Examiner*—Stephen J. Novosad
*Attorney, Agent, or Firm*—Alexander J. McKillop; Michael G. Gilman; George W. Hager, Jr.

[57] ABSTRACT

A subsurface formation surrounding a deviated borehole and having original in-situ stresses that favor the propagation of a vertical fracture is penetrated by a cased borehole. The casing is perforated at a pair of spaced-apart intervals to form a pair of sets of perforations. Fracturing fluid is initially pumped down said cased borehole and out one of said sets of perforations to form a first fracture that is oriented in a direction perpendicular to the direction of the least principal in-situ horizontal stress. The propagation of this first vertical fracture changes the in-situ stresses so as to favor the propagation of a second vertical fracture. This is oriented in a direction parallel to the direction of the least principal in-situ horizontal stress. Thereafter, while maintaining pressure in the first vertical fracture, fracturing fluid is pumped down said cased borehole and out of the other of said sets of perforations to form such a second vertical fracture which will now link naturally occurring fractures in the formation to the deviated wellbore.

8 Claims, 2 Drawing Figures

STIMULATION OF EARTH FORMATIONS SURROUNDING A DEVIATED WELLBORE BY SEQUENTIAL HYDRAULIC FRACTURING

CROSS REFERENCE TO RELATED APPLICATIONS

This application is related to U.S. application Ser. No. 938,892, filed on the same date herewith, entitled HYDRAULIC FRACTURING OF A SHALLOW SUBSURFACE FORMATION to the same inventor herewith.

BACKGROUND OF THE INVENTION

The invention relates to the hydraulic fracturing of an earth formation and more particularly to a method of sequential hydraulic fracturing of an earth formation surrounding a wellbore that is substantially deviated from the vertical.

In the completion of wells drilled into the earth, a string of casing is normally run into the well and a cement slurry is flowed into the annulus between the casing string and the wall of the well. The cement slurry is allowed to set and form a cement sheath which bonds the string of casing to the wall of the well. Perforations are provided through the casing and cement sheath adjacent the subsurface formation. Fluids, such as oil or gas, are produced through these perforations into the well.

Hydraulic fracturing is widely practiced to increase the production rate from such wells. Fracturing treatments are usually performed soon after the formation interval to be produced is completed, that is, soon after fluid communication between the well and the reservoir interval is established. Wells are also sometimes fractured for the purpose of stimulating production after significant depletion of the reservoir.

Hydraulic fracturing techniques involve injecting a fracturing fluid down a well and into contact with the subterranean formation to be fractured. Sufficiently high pressure is applied to the fracturing fluid to initiate and propagate a fracture into the subterranean formation. Proppant materials are generally entrained in the fracturing fluid and are deposited in the fracture to maintain the fracture open.

Several such hydraulic fracturing methods are disclosed in U.S. Pat. Nos. 3,965,982; 4,067,389; 4,378,845; 4,515,214; and 4,549,608 for example. It is generally accepted that the local in-situ stresses in the formation at the time of the hydraulic fracturing generally favor the formation of vertical fractures at depths greater than about 2000 to 3000 feet.

SUMMARY OF THE INVENTION

In accordance with the present invention, oil and gas production from a naturally fractured earth formation surrounding a deviated wellbore is stimulated by sequential hydraulic fracturing. Fracturing fluid is initially supplied to the formation at a first depth within the deviated wellbore to propagate a first vertical fracture as favored by the original in-situ stresses of the formation in a direction that is perpendicular to the least principal in-situ stress, the formation of such vertical fracture altering the local in-situ stresses. Fracturing fluid is thereafter supplied to the formation at a second depth within the deviated wellbore, while maintaining pressure in the first vertical fracture, to propagate a second vertical fracture in a direction that is parallel to the least principal in-situ stress as favored by the altering of the local in-situ stresses by the formation of the first vertical fracture, such that this second vertical fracture intersects the naturally occurring fractures in the formation which are perpendicular to the direction of the least principal in-situ stress so as to link such naturally occurring fractures to the wellbore and thereby stimulate the production of oil and gas from the formation.

In a more specific aspect of the invention, casing is set in the deviated wellbore and tubing is hung within the casing to a depth at which hydraulic fracturing is to be initiated, an annulus being formed between the tubing and the casing. A packer is placed in the annulus at a depth where the local in-situ stresses of the formation favor the propagation of a vertical fracture. Upper perforations are generated in the casing immemdiately above the packer. Lower perforations are generated in the casing near the bottom end of the tubing. Fracturing fluid is first supplied under pressure through the annulus and out the upper perforations into the formation to propagate the first vertical fracture through the formation in a direction perpendicular to the least principal in-situ stress. The propagation of this fracture alters the local in-situ stresses in the formation. Fracturing fluid is then supplied under pressure through the tubing and out the lower perforations into the formation to propagate the second vertical fracture through the formation in a direction parallel to the least principal in-situ stress as now favored by the altered local in-situ stresses.

DESCRIPTION OF THE PREFERRED EMBODIMENT

The present invention provides for a method for stimulating the production of oil or gas from earth formations surrounding a deviated wellbore by creating a vertical hydraulic fracture that links naturally occurring formation fractures to the wellbore.

The direction of naturally occurring fractures is generally dictated by the in-situ stresses which existed at the time the fracture system was developed. As in the case of hydraulic fractures, these natural fractures form perpendicular to the least principal in-situ stress. Since most of these natural fractures in a given formation are usually affected by the same in-situ stress, they tend to be parallel to each other. Very often, the orientation of the in-situ stress that existed when the natural fractures were formed coincides with the present in-situ stress. This presents a problem when conventional hydraulic fracturing is employed. For example, a vertical hydraulic fracture created in a naturally fractured formation generally propagates parallel to the direction of the natural fractures. This results in only poor communication between the wellbore and the natural fractures and does not provide for optimum oil or gas production.

The present invention is intended to solve this problem by a hydraulic fracturing technique in which the vertical hydraulic fracture is propagated in a direction perpendicular to the naturally occurring fractures so as to link them to the wellbore and greatly enhance or stimulate the production of oil or gas from the naturally fractured formation. This technique can best be understood by reference to FIGS. 1 and 2.

Figure 1:
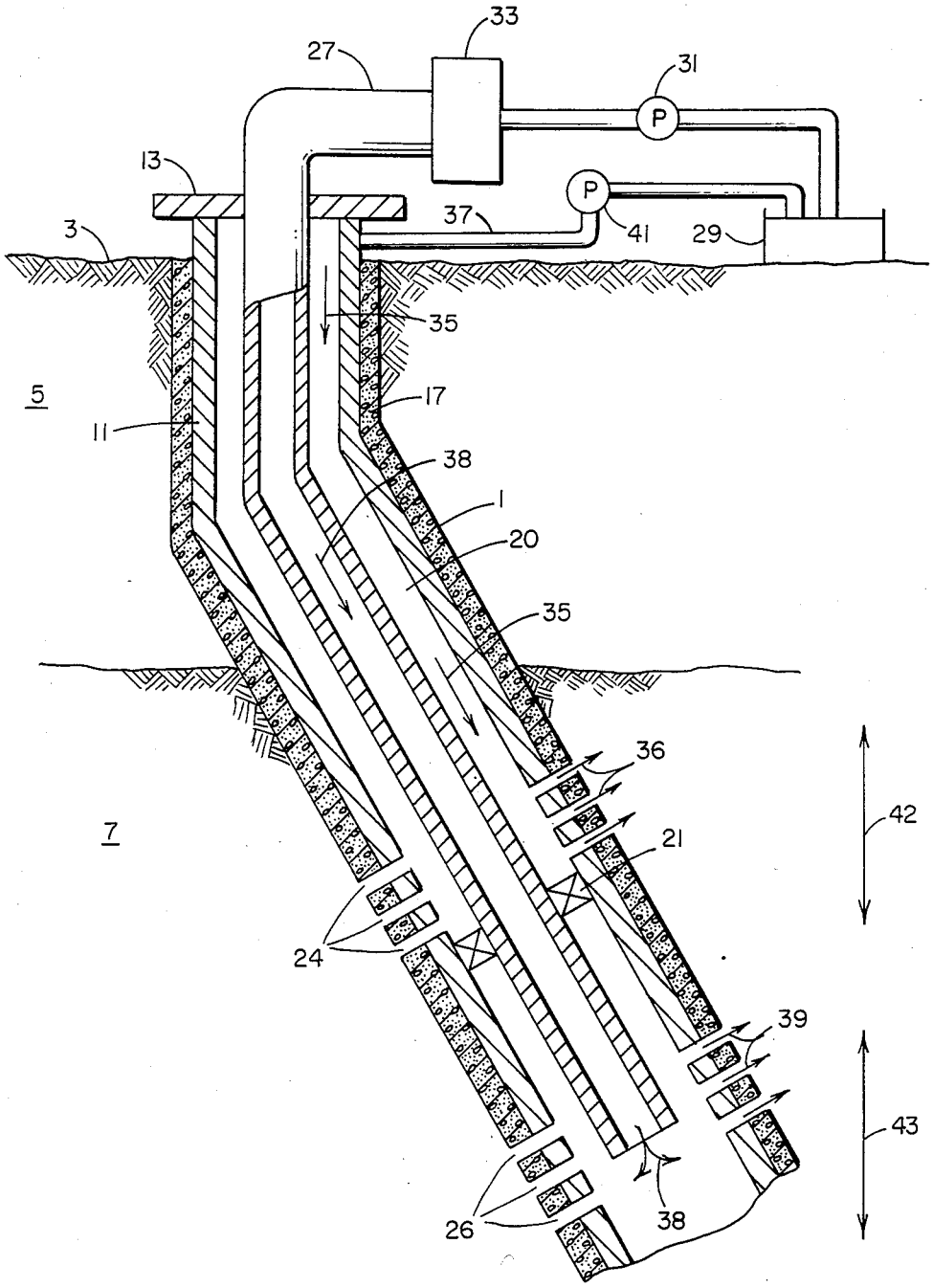
FIG. 1 illustrates apparatus associated with a deviated wellbore penetrating an earth formation to be hydraulically fractured in accordance with the present invention.

Referring first to FIG. 1, there is shown formation fracturing apparatus with which the hydraulic fracturing method of the present invention may be carried out. A deviated wellbore 1 generally exceeding 60° deviation from the vertical, extends from the surface 3 through an overburden 5 to a productive formation 7 where the in-situ stresses favor a vertical fracture. Casing 11 is set in the wellbore and extends from a casing head 13 to the productive formation 7. The casing 11 is held in the wellbore by a cement sheath 17 that is formed between the casing 11 and the wellbore 1. The casing 11 and cement sheath 17 are perforated at 24 and at 26 where the local in-situ stresses favor the propagation of vertical fractures. A tubing string 19 is positioned in the wellbore and extends from the casing head 13 to the lower end of the wellbore below the perforations 26. A packer 21 is placed in the annulus 20 between the perforations 24 and 26. The upper end of tubing 19 is connected by a conduit 27 to a source 29 of fracturing fluid. A pump 31 is provided in communication with the conduit 27 for pumping the fracturing fluid from the source 29 down the tubing 19. The upper end of the annulus 20 between the tubing 19 and the casing 11 is connected by a conduit 37 to the source 29 of fracturing fluid. A pump 41 is provided in fluid communication with the conduit 37 for pumping fracturing fluid from the source 29 down the annulus 20.

Figure 2:
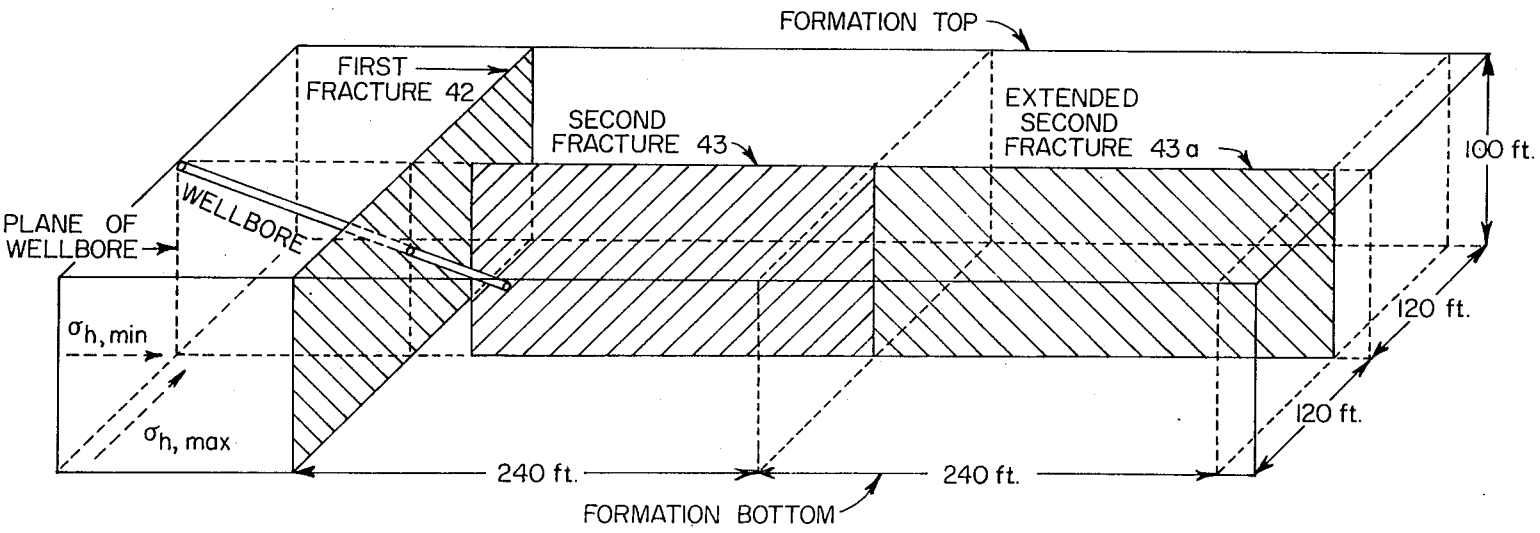
FIG. 2 is a pictorial representation of the vertical hydraulic fractures formed in the earth formation surrounding a deviated wellbore by use of the apparatus of FIG. 1.

In carrying out the hydraulic fracturing method of the present invention with the apparatus of FIG. 1 in a zone of the formation where the in-situ stresses favor a vertical fracture, the pump 41 is activated to force fracturing fluid down the annulus 20 as shown by arrows 35 through the perforations 24 into the formation as shown by arrows 36 at a point immediately above the upper packer 21. The in-situ stresses at this point that favor a vertical fracture are shown in the example of FIG. 2. A least principal horizontal stress ($\sigma_h$min) may be about 1750 psi and a maximum principal in-situ horizontal stress ($\sigma_h$max) may be about 1850 psi. For this example, a fluid pressure of 2150 psi may be maintained during the initial propagation of a vertical fracture 42 that is perpendicular to the direction of the least principal in-situ stress $\sigma_h$min by controlling the fracturing fluid flow rate through annulus 20 or by using well known gelling agents.

Due to the pressure in the vertical fracture 42, the local in-situ stresses in the formation are now altered from the original stresses to favor the formation of a vertical fracture that is parallel to the least principal in-situ stress $\sigma_h$min. Such a vertical fracture 43 can thereafter be formed in the formation by activating the pump 31 to force fracturing fluid down the tubing 19 as shown by arrows 38 and through the perforations 26 into the formation as shown by arrows 39 at a point near the bottom of the wellbore. This second vertical fracture 43 is propagated while maintaining the fluid pressure on the first fracture 42, which can either be stabilized in length or still propagating.

In the example of FIG. 2, the penetration of the second vertical fracture 43 is in the order of 240 feet from the plane of the first vertical fracture 42. If the pressure in the first fracture 42 were maintained at 3200 psi, for example, instead of 2150 psi, then the second fracture 43 would be extended in the order of 240 additional feet from the plane of the first fracture 42 as shown in FIG. 2 as the extended second fracture 43*a*. This penetration of the second fracture 43 and extended second fracture 43*a* is relative to that of the first fracture 42. If the penetrations or lengths of the wings of the first fracture 42 are doubled from 120 feet to 240 feet, for example, then the penetrations or length of the second fracture 43 and its extension 43*a* are doubled from 480 feet total to 960 feet total, for example.

Instead of initiating the vertical fracture 42 above the vertical fracture 43 as described above and as shown in FIG. 2, the fracturing fluid could be firstly pumped down tubing 19 and out perforations 26 to form the vertical fracture 42 near the bottom of the wellbore and thereafter pumping the fracturing fluid down the annulus between the casing 11 and tubing 19 and out perforations 24 to initiate the vertical fracture 43 above the vertical fracture 42.

Having now described a preferred embodiment for the method of the present invention, it will be apparent to those skilled in the art of hydraulic fracturing that various changes and modifications may be made without departing from the spirit and scope of the invention as set forth in the appended claims. Any such changes and modifications coming within the scope of such appended claims are intended to be included herein.

I claim:

1. A method for the stimulation of oil and gas production from a naturally fractured earth formation surrounding a deviated wellbore by sequential hydraulic fracturing, comprising the steps of:

(a) firstly supplying fracturing fluid to said formation at a first depth within said deviated wellbore to propagate a first vertical fracture as favored by the original in-situ stresses of the formation in a direction that is perpendicular to the least principal in-situ stress, the formation of said first vertical fracture altering the local in-situ stresses, and (b) secondly supplying fracturing fluid to said formation at a second depth within said wellbore, while maintaining pressure in the first vertical fracture, to propagate a second vertical fracture through said formation in a direction parallel to said least principal in-situ stress as favored by the altering of the local in-situ stresses by said first vertical fracture, such that said second vertical fracture intersects the naturally occurring fractures in said formation which are perpendicular to the direction of said least principal in-situ stress so as to link said naturally occurring fractures to the wellbore and thereby stimulate the production of oil or gas from said formation.

2. The method of claim 1 further comprising the steps of:

(a) setting casing in said deviated wellbore, (b) generating perforations in said casing at said first and second depth points, and (c) fluidly isolating the perforations at said first depth point from the perforations at said second depth point with respect to the supplying of said fracturing fluids to said formation.

3. A method for the stimulation of oil or gas production from a naturally fractured earth formation surrounding a deviated wellbore by sequential hydraulic fracturing, comprising the steps of:

(a) setting casing in a deviated wellbore penetrating said naturally fractured earth formation, (b) generating upper perforations in said casing at a depth where the local in-situ stresses of the formation favor the propagation of a vertical fracture, (c) generating lower perforations in said casing at a depth where the local in-situ stresses of the formation favor the propagation of a vertical fracture, (d) hanging tubing within said casing to the depth of said lower perforations, an annulus being formed between said tubing and said casing, (e) placing a packer in said annulus between said upper and said lower perforations, (f) supplying fracturing fluid under pressure through said annulus and said upper perforations to said formation to propagate a first vertical fracture through said formation in a direction perpendicular to the least principal in-situ stress, the formation of said first vertical fracture altering the local in-situ stress of the formation, and (g) supplying fracturing fluid under pressure through said tubing and said lower perforations, while maintaining pressure in said first vertical fracture, to said formation to propagate a second vertical fracture through said formation in a direction parallel to said least principal in-situ stress as favored by the altering of the local in-situ stress by said first vertical fracture, such that said second vertical fracture intersects the naturally occurring fractures in said formation which are perpendicular to the direction of said least principal in-situ stress so as to link said naturally occurring fracturing to the wellbore and thereby stimulate the production of oil or gas from said formation.

4. A method for the stimulation of oil or gas production from a naturally fractured earth formation surrounding a deviated wellbore by sequential hydraulic fracturing, comprising the steps of:

(a) setting casing in a deviated wellbore penetrating said naturally fractured earth formation, (b) generating upper perforations in said casing at a depth where the local in-situ stress of the formation favor the propagation of a vertical fracture, (c) generating lower perforations in said casing at a depth where the local in-situ of the formation favor the propagation of a vertical fracture, (d) hanging tubing within said casing to the depth of said lower perforations, an annulus being formed between said tubing and said casing, (e) placing a packer in said annulus between said upper and said lower perforations, (f) supplying fracturing fluid under pressure through said tubing and said lower perforations to said formation to propagate a first vertical fracture through said formation in a direction perpendicular to the least principal in-situ stress, the formation of said first vertical fracture altering the local in-situ stress of the formation, and (g) supplying fracturing fluid under pressure through said annulus and said upper perforations to said formation, while maintaining pressure in said first vertical fracture, to propagate a second vertical fracture through said formation in a direction perpendicular to said first fracture as favored by the altering of the local in-situ stress by said first vertical feature, such that said second vertical fracture intersects any naturally occurring fractures in said formation which are perpendicular to the direction of said least principal in-situ stress so as to link said naturally occurring fractures to the wellbore and thereby stimulate the production of oil or gas from said formation.

5. The method of claims 1, 3 or 4 wherein the fluid pressure applied to said formation during the propagation of said first vertical fracture is maintained during the propagation of said second vertical fracture.

6. The method of claim 1, 3 or 4 wherein said wellbore is deviated at least 60° from the vertical.

7. The method of claims 1, 3 or 4 wherein said deviated wellbore is parallel to the direction of the least principal in-situ stress and the length of said second vertical fracture is relative to the length of said first vertical fracture in a direction that is also parallel to the direction of the least principal in-situ stress.

8. The method of claims 1, 3 or 4 wherein said wellbore is not parallel to the direction of the least principal in-situ stress and said second vertical fracture initially propagates in a direction parallel to the least principal in-situ stress and thereafter curves so as to finally propagate in a direction perpendicular to said least principal in-situ stress.

* * * * *